United States Patent [19]

Inagaki

[11] Patent Number: 4,669,251

[45] Date of Patent: Jun. 2, 1987

[54] PACKAGING BAGS

[75] Inventor: Hiromichi Inagaki, Inuyama, Japan

[73] Assignee: Nihon Tokkyo Kanri Company Limited, Japan

[21] Appl. No.: 778,557

[22] Filed: Sep. 20, 1985

[51] Int. Cl.[4] ..... B65D 33/00

[52] U.S. Cl. ..... 53/385; 206/554; 383/9; 493/347

[58] Field of Search ..... 383/9; 206/554; 493/194, 196, 204, 210, 248, 347; 53/385

[56] References Cited

U.S. PATENT DOCUMENTS

| | | | |
|---|---|---|---|
| 2,348,196 | 5/1944 | Duhaime | 493/194 |
| 2,790,591 | 4/1957 | Rosen | 383/9 |
| 3,044,233 | 7/1962 | Altman | 206/554 |
| 3,797,732 | 3/1974 | Melin et al. | 383/9 |
| 4,519,504 | 5/1985 | Nausedas | 206/554 |

*Primary Examiner*—Stephen P. Garbe

*Attorney, Agent, or Firm*—McGlew and Tuttle

[57] ABSTRACT

A packaging bag has a mouth which is shaped so that it can be opened by blowing air into the mouth. A stack of such bags are folded flatly and are sequentially opened for receiving articles. Each bag has a back wall with hooking holes provided for receiving a stacking hook. The front wall of each bag has a large notch which overlies the holes with clearance to permit easy raising of the front wall when air is used to open the mouth. The hooking holes are also formed so that they are easily torn when the bag is pulled off the hook in a direction away from the mouth. To this end, each hook hole has a sharp portion in the direction of the mouth.

2 Claims, 7 Drawing Figures

PACKAGING BAGS

FIELD AND BACKGROUND OF THE INVENTION

This invention relates to a flatly folded bag where only the mouth, for receiving articles, is in an unsealed state while other parts are completely sealed. In the inventive article packing bag, the mouth is opened by blowing air toward the mouth and thus the articles can be thrown into the bag through the mouth, while the mouth is kept open.

The mouth of the packing bag must be opened by mechanical means for automatically packing the articles into the bags. It is well known to use suction discs in a technique for opening such bags. The use of suction discs, however, involves a problem, since the structure becomes complicated e.g. in the mechanism for actuating the discs or in the vacuum mechanism.

Therefore, as means of opening the mouth of bags without using these suction discs, Japanese utility model application No. 57-159323 teaches the usefulness of sending air toward the mouth of the bags and utilizing the force of this air to open the bags. FIG. 7 illustrates the bag of this patent application. This bag 01 has a back face 03 which is top most as illustrated in FIG. 7. Back face 03 includes slits 05 and 05' each having a certain length from the brim 02 of the bag mouth. The slits are at metrical positions with respect to a central joint section 04 in the back face 03. Joint section 04 is also positioned between hooking holes 06 and 06', provided at positions oppositely facing slits 05 and 05', on a front face 70 of the bag. When air is blown in the direction of the arrow marked "a", the air is accepted into the bag 01 to allow the slits 05 and 05' to rise on and escape from a lock metal 08 which extends through the slits and through holes 06 and 06'. The air also opens the mouth of bag 01. Articles are then thrown into the bag 01 while the mouth is kept opened. When the charging of articles is completed, the bag 01 is pulled in the direction of the arrow marked "b". When the bag 01 is pulled, the hooking holes 06 and 06' are to be torn from the lock metal 08.

This type of bag, however, requires much trouble in its preparation because the gap between legs of the lock metal 08 must always coincide with the gap between the slits 05 and 05' since the slits must slide past the lock metal 08 in two straight lines on the right and left. The legs of the lock metal 08 must meet the gap of slits 05 and 05' and this may not happen if there is a difference in the dimensions of bag 01. Further, because of the shape of slits 05 and 05', the lock metal 08 oftens touches edges of slits 05 and 05' and the degree of opening for the mouth for successive bags 01, differ from one bag to the next. This causes trouble in charging articles into the bags since the edges of slits 05 and 05' may be hooked by the lock metal 08.

Also, since the hooking holes 06 and 06' are open against the slits 05 and 05', and are circular it is difficult to tear the bag from lock metal 08 when it is pulled in the "b" direction and further the direction of tearing is not stable. The mouth portion of bag 01 is thus often disturbed, resulting in a bad appearance for the bag.

SUMMARY OF THE INVENTION

A primary object of the present invention is to provide a bag which can be folded flat, thus permitting the mouth of the bag to open widely and smoothly at all times by using air, while the bag is held by the lock metal. In addition, a further object is to have the mouth of the bag torn off in a nice line when it is pulled for detaching the bag containing articles from the lock metal.

DESCRIPTION OF THE PREFERRED EMBODIMENTS

Figure 1:
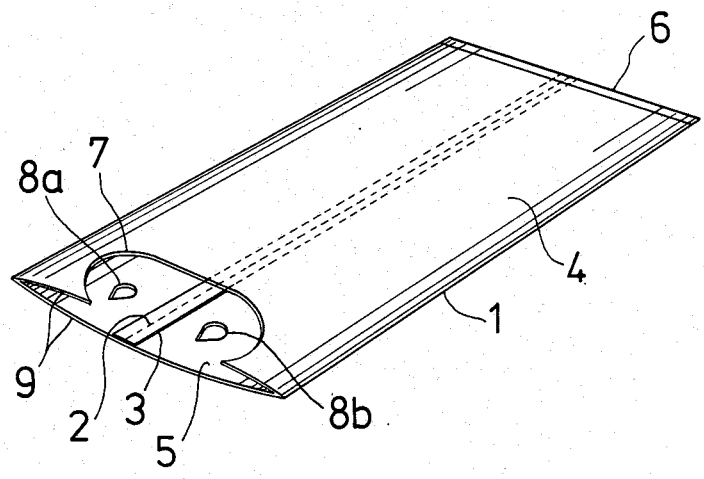
FIG. 1 is a perspective view of a bag constructed in accordance with the invention.

Referring to FIG. 1 in particular, the invention embodied therein comprises a packaging bag 1 which is made of a sheet of plastic film rolled into a tube and sealed at seal joint 2. Joint 2 is formed by plastic tape 3 which is adhered to joint 2 by adhesive, heat sealing or other means. The main body of bag 1 has a front side 4 and a rear side 5. Joint 2 is disposed at the rear side 5. The bottom of bag 1 is sealed at bottom seal 6.

At its center, the front side or wall 4 of bag main body 1 has a notch portion or recess 7 which is in the shape of an inverted "C" shape and extends from the mouth edge 9 into the front wall 4. Hook holes **8*a* and 8*b* are provided to the rear side or wall 5, facing the aforesaid notch portion 7. These hook holes 8*a* and 8*b* are, as shown in FIG. 2, provided with a V-shaped tearing portion 10 in the direction toward the mouth edge 9 from the hooking holes 8*a* and 8*b***.

Figure 2:
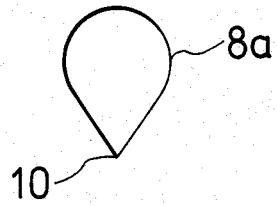
FIGS. 2 and 3 are plan views showing the profile of two embodiments of hooking holes for retaining the bag onto a lock metal.
Figure 3:
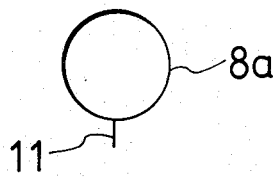

For information, the profile of this tearing portion 10 is as shown in FIG. 2, but it can also be a straight line slit 11 as shown in FIG. 3. Each of the hooking holes need only have a sharp end portion in the direction of the mouth edge 9.

Figure 4:
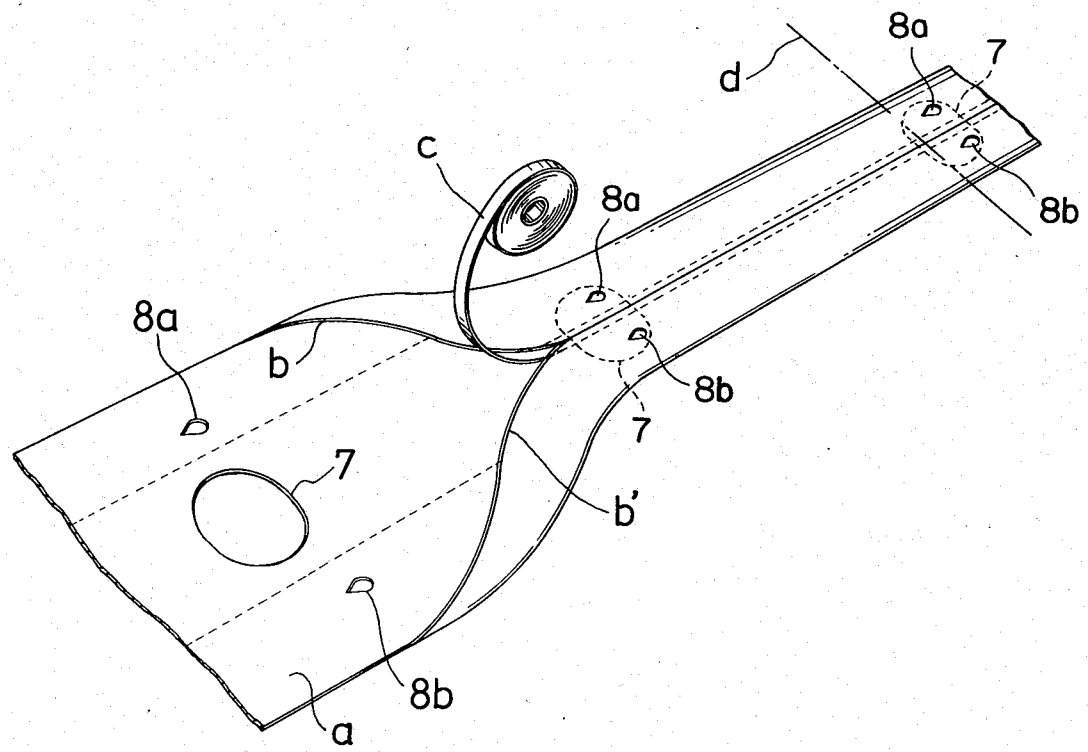
FIG. 4 is an explanatory perspective view of the production method for the bag which is shown in FIG. 1.

FIG. 4 illustrates one example of how the bag of FIG. 1 can be produced.

First of all, the notch portion 7 and the hooking holes **8*a* and 8*b*** are cut into a flat plastic film "a" which has been unrolled from a roll. Next, both the side edges b and b' of the aforesaid flat film "a" are pulled together so that film "a" is rolled into a cylindrical shape. This is done by utilizing a sealer, of known type (not shown). Tape "c" is then inserted onto the interior of both side edges "b" and "b'" which have been butted together, for joining both the edges together using this tape "c".

In the next step, the film "a" that has been formed to a cylindrical shape, is cut at the line "d" using a cutting blade and the film is sealed at the bottom. This cutting step also opens the aforesaid notch portion 7 which was originally a simple aperture in film "a".

Besides the above example for joining both the edges "b" and "b'" together by inserting the tape "c", this joining method can be either of an envelope pasting or a rafter roof type pasting which are of known type. The size of notch portion 7 is selected so that, with the bag formed, notch portion 7 overlies the holes 8*a* and 8*b*, with clearance. With the cut along line "d", as shown in FIG. 4, notch portion 7 is open toward the mouth edge 9 for the easy passage of a lock metal or hook.

Figure 5:
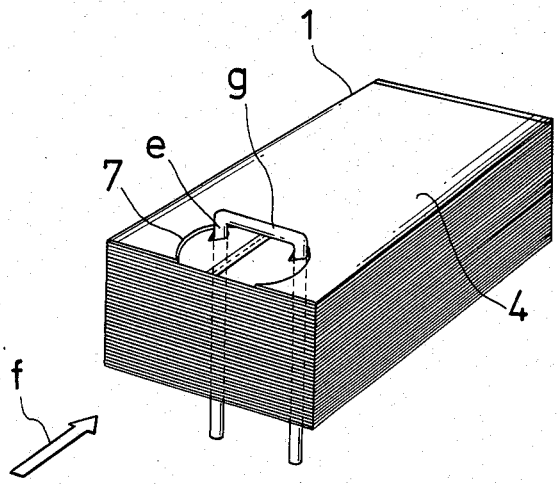
FIG. 5 is a perspective view of the bags placed in a stack and on the lock metal.
Figure 6:
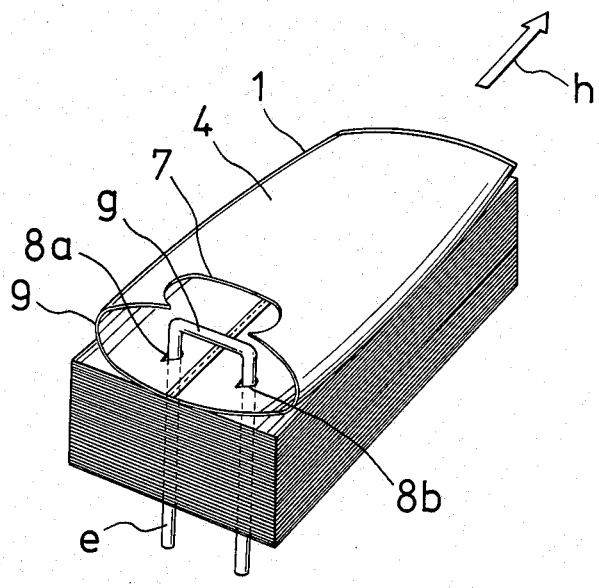
FIG. 6 is a perspective view similar to FIG. 5 but showing the uppermost bag with its mouth opened widely by blowing air into the mouth of the bag.
Figure 7:
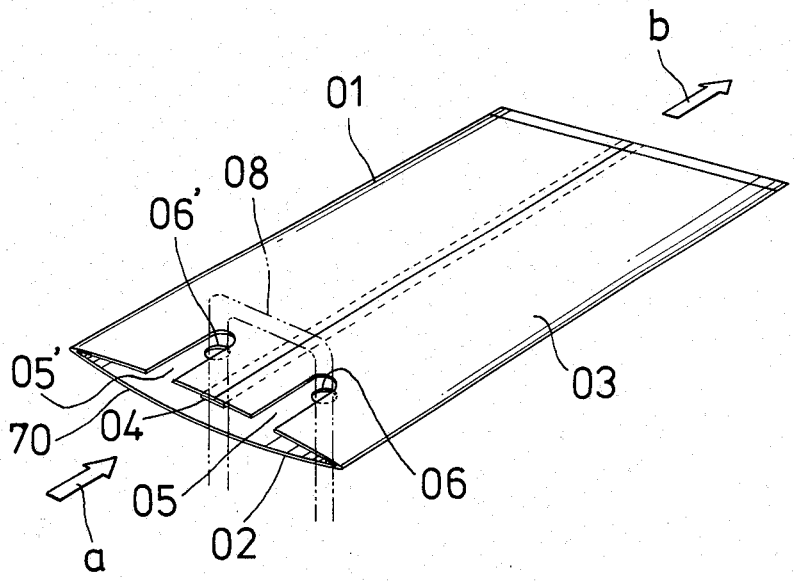
FIG. 7 (PRIOR ART)
FIG. 7 is a perspective view of a conventional type of bag.

FIGS. 5 and 6 show an example in which the inventive bags are loaded onto an automatic charging machine (not shown), and the bags are stacked up and retained in place by a lock metal "e" having two legs extending through the hooking holes 8*a* and 8*b*. For opening the mouths of the bags in this situation, it is necessary to blow air into the mouths in the direction of arrow f as shown in FIG. 5. This can be done by using a fan. With the design of the invention, the front wall 4 of the bag main body 1 placed on the top, escapes from the horizontal bar "g" of lock metal "e", via the notch portion 7, so that the air flows into the bag main body 1 and opens the mouth of the bag as shown in FIG. 6. The articles can then be charged into the bag while it is in the state as shown in FIG. 6. When the charging step is finished, the bag will be pulled in the direction of arrow "h". As a result, the hooking holes 8*a* and 8*b* which have been connected to the lock metal "e", are torn in the direction of mouth edge 9, along the sharp portion 10 (or 11) and are disengaged from the lock metal "e".

Since this invention, as mentioned above is provided not only with the notch portion 7 at the front wall 4 of bag main body 1, but also with the sharp portion 10 at the hooking holes 8*a* and 8*b* the effects as given below can be expected.

a. The identical lock metal or hook "e" can be used for bags of different sizes by employing a single notch portion 7 in each bag and by keeping it large regardless of the size (or kind) of bags.

The preparation for work can be made easier without the need for replacing the lock metal "e" for different sizes to meet each size of different bags as found in the conventional system.

b. Since the notch portion 7 has been designed to have a larger size, the lock metal "e" is prevented from being hooked onto the edge of notch portion 7.

For this reason, the bag main body 1 can be opened to the same size at all times by air pressure.

c. since a sharp portion 10 or 11 has been provided in the hooking holes 8*a* and 8*b*, the tearing direction can be directed to the side of mouth edge 9 at all times, and tearing can be done with ease.

Consequently, because the tearing force can be made smaller and the torn area looks neat and tidy, the appearance of the bag is also better.

While specific embodiments of the invention have been shown and described in detail to illustrate the application of the principles of the invention, it will be understood that the invention may be embodied otherwise without departing from such principles.

What is claimed is:

1. A method of forming a packaging bag having a mouth which can be blown open by air while the bag is held on a lock hook, comprising:

cutting a pair of hooking holes in an elongated film of material;

cutting an enlarged aperture in the film between the hooking holes;

bringing opposite side edges of the film into engagement with each other for rolling the film into a cylindrical shape;

sealing the side edges together to form a joint with the hooking holes on opposite sides of the joint and the aperture facing the joint. the cylindrical shape having a rear wall containing the hooking holes and joint, and a front wall containing the aperture;

cutting the cylindrical shape near one edge of the aperture for opening the aperture into a recess and for defining a mouth edge for the bag.

2. A method according to claim 1, including cutting the hooking holes so as to have a tear facilitating means in the direction of the mouth edge and cutting the aperture so that it forms a recess which overlies the hooking holes with clearance.

* * * * *